United States Patent [19]

Potter

[11] 3,981,378

[45] Sept. 21, 1976

[54] MUFFLER FOR PILE DRIVING APPARATUS

[75] Inventor: Stannard M. Potter, Glastonbury, Conn.

[73] Assignee: Horn Construction Co., Inc., Merrick, N.Y.

[22] Filed: Oct. 16, 1974

[21] Appl. No.: 515,226

[52] U.S. Cl. ..... 181/50; 173/DIG. 2; 181/42; 181/53; 181/60; 181/36 A

[51] Int. Cl.[2] ..... F01N 1/10; F01N 1/24

[58] Field of Search ..... 181/35 B, 35 C, 61, 181/53, 42, 50, 60, 36 A; 173/DIG. 2

[56] References Cited

UNITED STATES PATENTS

| | | | |
|---|---|---|---|
| 1,811,762 | 6/1931 | Schnell | 181/42 |
| 1,953,543 | 4/1934 | Rensink | 181/50 X |
| 1,988,048 | 1/1935 | Peik | 181/50 |
| 2,583,366 | 1/1952 | Engels | 181/42 |
| 2,834,425 | 5/1958 | Rawson | 181/42 |
| 3,590,947 | 7/1971 | Latch et al. | 181/53 |
| 3,842,940 | 10/1974 | Bonikowski | 181/50 |
| 3,851,727 | 12/1974 | Getz et al. | 181/50 |

FOREIGN PATENTS OR APPLICATIONS

| | | | |
|---|---|---|---|
| 58,806 | 4/1954 | France | 181/42 |
| 232,987 | 6/1944 | Switzerland | 181/50 |
| 379,563 | 9/1932 | United Kingdom | 181/42 |

*Primary Examiner*—John Gonzales
*Attorney, Agent, or Firm*—Morgan, Finnegan, Pine, Foley & Lee

[57] ABSTRACT

A muffler system for attenuating exhaust noise from pile driving apparatus including an exhaust passage therein having perforated straight sections and unperforated curved sections. The exhaust passage is surrounded with acoustical absorbing material and screen means is interposed between the exhaust passage and the absorbing material. The muffler system can be adapted for modular construction whereby modular muffler section can be stacked and connected in series to provide a muffler passage of desired length to fit within a confined width.

20 Claims, 11 Drawing Figures

MUFFLER FOR PILE DRIVING APPARATUS

BACKGROUND OF THE INVENTION

Pressure fluid actuated tools such as pile drivers are normally driven by steam or compressed air. These devices generate two types of noise: noise from the hammer impact and noise from exhaust leaving the hammer actuating chamber. The latter is created by the release of the exhaust and is commonly referred to as "jet noise". It is created by high velocity air turbulence as the exhaust air leaves the actuating chamber and flows through nonaerodynamic turns in the passages leading to the atmosphere.

Recently, concern has been raised over noise levels in the environment which has resulted several laws and ordinances prescribing certain noise level codes. Prominent examples include ordinances in very large cities, such as New York City, where the urban din from construction, traffic, etc. can sometime prove intolerable.

Many commercial reactive-type exhaust mufflers for pressure actuated tools reduce the noise produced thereby but at cost of generating substantially high back-pressure due to the drastic slowing of the high velocity exhaust flow, especially those having baffles within the exhaust chamber. See for example U.S. Pat. No. 2,128,742 to Fuehrer and U.S. Pat. No. 2,561,726 to Cherain.

Alternatives to these mufflers include absorptive types which have either elongated or round housings. These designs provide desirable acoustical characteristics by providing high absorption while exhibiting minimal reverberation which would otherwise contribute noise by transforming the muffler housing into a noise source. However, they suffer disadvantages from a practical standpoint in that their shapes are inconvenient for attaching to pile driving apparatus since the muffler is exposed to severe jolts and vibrations.

SUMMARY OF THE INVENTION

It is therefore an object of the present invention to provide a muffler which can be easily installed on existing equipment without necessitating additional equipment or supplementary structures.

It is another object of the present invention to provide an absorptive muffler whose housing exhibits little or no reverberation and is capable of simple attachment to the pile driving apparatus.

It is also an object of the present invention to provide an exhaust muffler for pile driving apparatus which substantially attenuates the noise generated by the release of exhaust without inducing appreciable back pressure.

It is a further object of the present invention to attenuate the noise generated by the release of exhaust without permitting the accumulation of oils, grease and moisture on the acoustical material within the muffler housing.

It is still another object of the present invention to prevent the deposit and build-up of oils, grease and other exhaust constituents upon the pile driving apparatus.

These and other objects and advantages of the present invention will be apparent from a reading of the detailed description in conjunction with the figures of the drawing.

The present invention relates to mufflers for pressure actuated machinery and more specifically to a muffler for pile driving apparatus.

In accordance with the present invention, a box-like housing which fits within the leeds of the pile driving apparatus encloses a hollow muffler passage which is surrounded by screening and acoustical absorbing material. The muffler passage is constructed with perforated straight sections and unperforated curved sections. The perforated section of the muffler passage is covered with screening and wrapped tightly with acoustical absorbing material. The muffler is capable of a modular construction wherein a plurality of muffler modules can be connected in series and stacked to form a serpentine muffler passage of desired length such that the muffler can be conveniently placed on top of the cradle of the pile driver to fit within the confined space between the leeds. Thus, the design of the present invention allows use of the muffler on existing machinery without necessitating larger leeds or installing additional supporting apparatus.

A particularly useful design for the muffler comprises a "U-shaped" muffler passage having perforated straight leg sections separated by a solid steel septum. The "U-shaped" design is especially adapted to allow a compact housing which can sit directly on top of the cradle of the pile driver within the leeds. A rubber pad is therefore placed on top of the cradle under the muffler housing to isolate the hammer impact transmitted to the cradle so as to prevent structural damage and to prevent sound waves from being transferred to the housing which would otherwise vibrate to add further noise.

These and other more detailed objects and advantages of the present invention will become more evident upon reading the following detailed description in conjunction with the attached drawings in which.

DETAILED DESCRIPTION OF THE INVENTION

Figure 1:
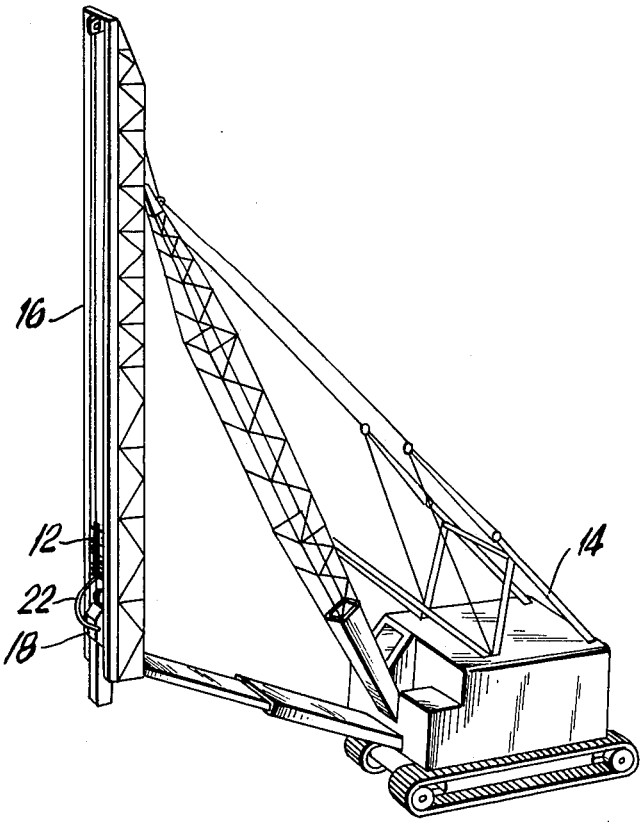
FIG. 1 is a schematic of a typical pile driving apparatus.

Referring now to FIG. 1, the pile driver exhaust muffler, 12, is shown in conjunction with a typical pile driving apparatus, 14, having leeds, 16, and cradle assembly 18.

Figure 2:
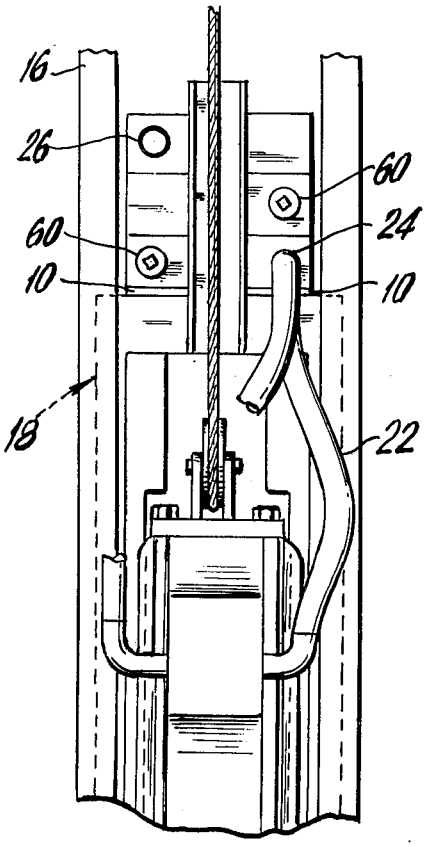
FIG. 2 is a front view of a stacked modular exhaust muffler and hammer cradle.
Figure 3:
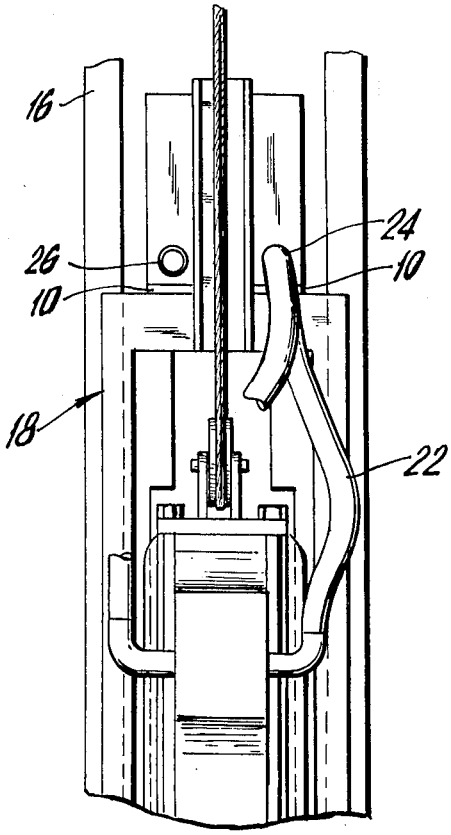
FIG. 3 is a front view of the muffler according to the present invention having a U-shaped muffler passage.

Referring to FIGS. 2 and 3, the stacked modular exhaust muffler is shown in conjunction with the pile driving leeds and cradle assembly with rubber pad, 10, interposed between the muffler and the cradle. Conduits, 22, direct the exhaust or exhausts from the combustion chamber to the muffler inlet, 24, while the muffler outlet 26, expels the quieted exhaust horizontally away from the muffler and pile driver assembly.

Figure 4:
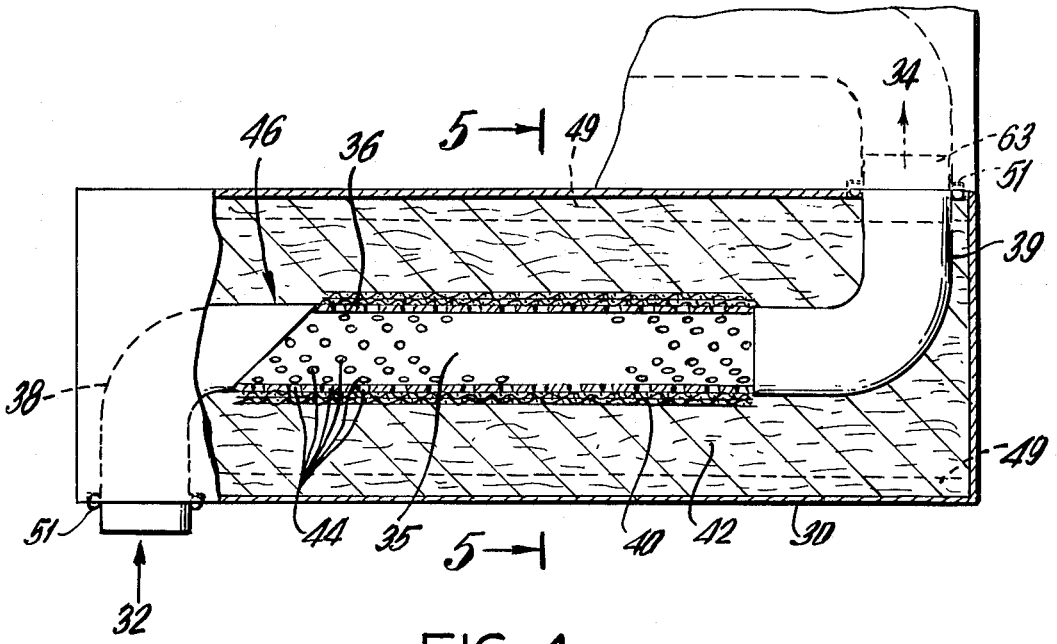
FIG. 4 is a front view showing the internal configuration of the muffler according to the present invention.

The basic embodiment of the present invention is depicted in FIG. 4 wherein the muffler is enclosed by housing 30, a substantially elongated box-like structure having inlet port 32 and outlet port 34. Advantageously, the outlet and inlet ports are located on side plates of the housing rather than the end plates in order that the muffler can fit easily within the leeds of the pile driving apparatus. Furthermore, quieted exhaust will therefore be expelled horizontally away from the equipment so that neither the muffler nor the pile driving apparatus will be sprayed with grease, oil, etc.

Figure 5:
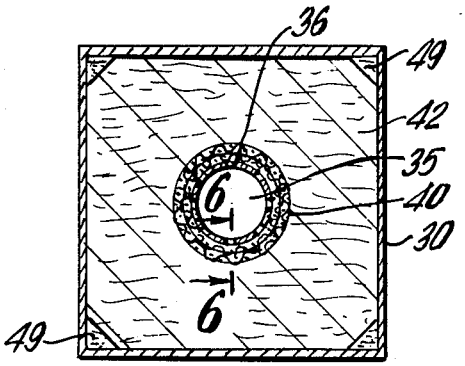
FIG. 5 is a cross-sectional view taken along the line 5—5 of FIG. 4.
Figure 6:
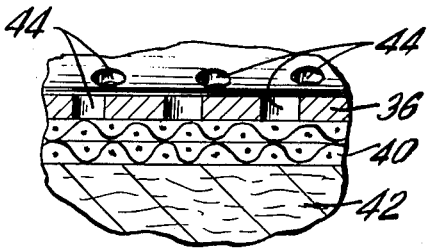
FIG. 6 is an enlarged view of a section of the perforated straight section of the muffler according to the present invention, taken along the line 6—6 of FIG. 5.

Referring to FIGS. 4 and 5, the muffler includes muffler passage 35 having perforated straight section 36 and unperforated curved sections or end pieces 38 and 39 which are conduits connecting the straight section to the inlet and outlet ports, respectively. The perforated straight section of the muffler passage is wrapped with and surrounded by screening means 40. A particularly useful screening means comprises a fine wire 1/16 inch mesh crisscross screen which is wrapped twice around the muffler passage to prevent exhaust air from physically leaving and entering the perforations in the muffler passage while not preventing acoustical waves from penetrating both the perforations and screening. The muffler passage is surrounded with acoustical absorbing material 42 which completely fills the space between the muffler passage and the housing to absorb energy from the acoustical waves permeating this space. In addition, the absorbing material functions as a damper on the housing to prevent reverberations which would otherwise transform the housing into a source of noise. FIG. 6 shows an enlarged view of a section of straight portion 36, along the cut 6—6, which has perforations 44, two layers of screening 40 and acoustical absorbing material 42.

Although a smaller diameter muffler passage is advantageous from the standpoint that it presents a smaller surface area for radiating noise, the muffler chamber and the fittings and hoses connected thereto should be comparable in diameter to the exhaust port of the actuating chamber to avoid back pressure in the flow of the exhaust. Back pressure has little effect on the performance of the pile hammer until the diameter of the muffler passage is as small as about one-half the diameter of the actuating chamber exhaust port. However, when the pile driver operates in cooler temperatures, about 50°F. or less, the velocity of the exhaust air increases as it flows into the smaller diameter. The higher velocity exhaust air will therefore be cooled as its velocity increases, causing moisture therein to freeze on the inner wall of the muffler passage. Thus, the passage diameter is effectively reduced which further increases the exhaust air velocity so that the phenomenon spirals until the entire muffler is clogged by ice, severely effecting operation of the pile driver. Hence, a particularly useful diameter for the muffler passage is about 4 inches.

In operation, exhaust enters inlet port 32 from the hammer actuating chamber or other exhaust sources and is directed by unperforated inlet end piece 38 to the perforated straight section 36 of the muffler passage. Acoustical waves from the exhaust air passes through the perforations 44 to screening 40 which allows these acoustical waves to leave and enter the exhaust passage without depositing oil, grease or other exhaust constituents on the acoustical absorbing material since it prevents exhaust air from physically leaving the perforations to enter the absorbing material. It therefore traps substantially all the oil and other suspended contaminants in the exhaust. Furthermore, screen mesh 40 increases the pressure drop across the perforations and increases the damping of oscillatory flow across each hole so that the flow resistance is improved. This phenomenon enables attenuation of a broad band of sound frequencies rather than peak damping of a small range of frequencies. The broadband damping is more desirable since exhaust noise is composed of a relatively large range of sound frequencies.

Acoustical waves therefore penetrate absorbing material 42 wherein the waves are reflected among the filler fibers, whereby heat is generated which increases the temperature of the filler, resulting in a loss of energy in the sound wave. Acoustical waves of diminished energy and volume re-enter the muffler passage through the perforations to rejoin the flowing exhaust air which is ultimately forced to unperforated outlet end piece 39. The quieted exhaust is then directed to outlet port 34 where it is expelled from the muffler. The inlet and outlet ports can be on the same or opposite sides of the housing so that the expelled exhaust will be directed horizontally away from the muffler and the pile driving apparatus to prevent any oil or other contaminant from coating the muffler or pile driving apparatus.

The preferred muffler housing and exhaust passage are both made of steel and the preferred acoustical absorbing material is fiberglass. Preferably, the fiberglass contains no binders or a minimum quantity whereby sound waves lose energy to the fiberglass in two ways. First, the acoustical waves are reflected among the fibers which absorb energy in the form of heat, manifested as an increase in the temperature of the fiberglass. Secondly, without the binders, the junctions of the fibers move in response to the pressure of the sound waves so that further energy is lost to the fiberglass in moving these junctions. The fiberglass is therefore finely woven, loosely but densely packed. Furthermore, fiberglass is particularly desirable because, due to its elasticity, it can be wrapped around the exhaust passage in such density that it not only has a damping effect on the housing but also prevents deterioration of the fibers.

The muffler preferably further includes bonded fiberglass cornerpieces 49 (shown in FIG. 5) which are affixed into all the lengthwise corners of the housing. These cornerpieces are triangular in cross-section and glued into the corners whereby they ensure the proper packing and positioning of the fiberglass filler by supporting the tightly wrapped fiberglass to enhance the density with which it is wrapped; they fill the voids in the corners to prevent noise concentration therein;

and, they damp the housing to further prevent reverberation of the housing. Advantageously, the corner-pieces have right triangular cross-sections with leg portions of about two inches in length. Inlet end piece 38 is preferably formed with aerodynamic shield extension 46 which extends the unperforated section of the muffler passage into straight section. This small unperforated straight section bars access of the oil and contaminant containing exhaust air to the acoustical fibers as the exhaust flow is "bent" into the perforated straight section.

Figure 7:
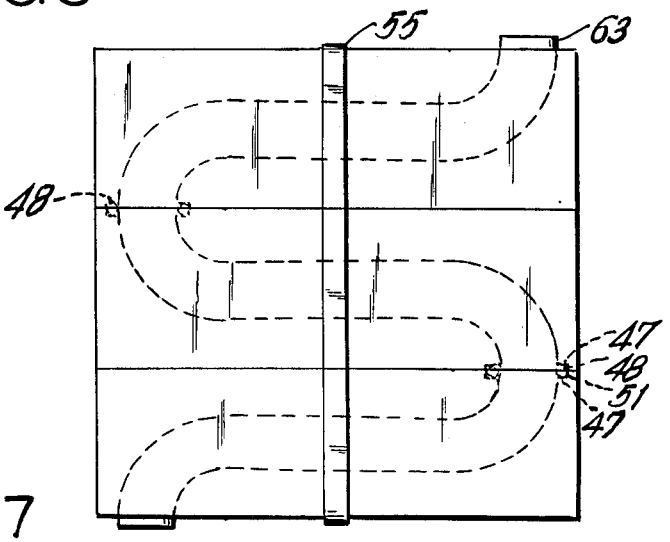
FIG. 7 is an internal view of the muffler passage in the stacked modular muffler according to the present invention.

FIG. 7 depicts a particularly useful application of the present invention wherein a plurality of muffler modules can be connected in series to provide a muffler passage of desired length. The muffler modules are connected by connecting means 48 which acts as a conduit for exhaust from the outlet of one muffler module to the inlet of the next. Advantageously, the inlet and outlet on each muffler are on opposite sides of the housing so that they can be conveniently stacked on top of one another such that the outlet of one module is adjacent the inlet of the next module to form a serpentine-like muffler passage of desired length.

Advantageously, the connecting means for joining muffler outlets and inlets comprises recesses 47 and o-ring 51 which fits therein. The o-ring is compressed to seal the muffler passage at the coupling between adjacent muffler modules to prevent leakage of exhaust air and its accompanying exhaust noise. Preferably, the outlet has a small protrusion 63 which acts to aid in the securing of the o-ring. Furthermore, when the desired length of muffler passage has been selected and built, fastener or strap 55 can be secured around the sections to urge them together for an acoustically secure connection at the couplings between inlets and outlets.

Figure 8:
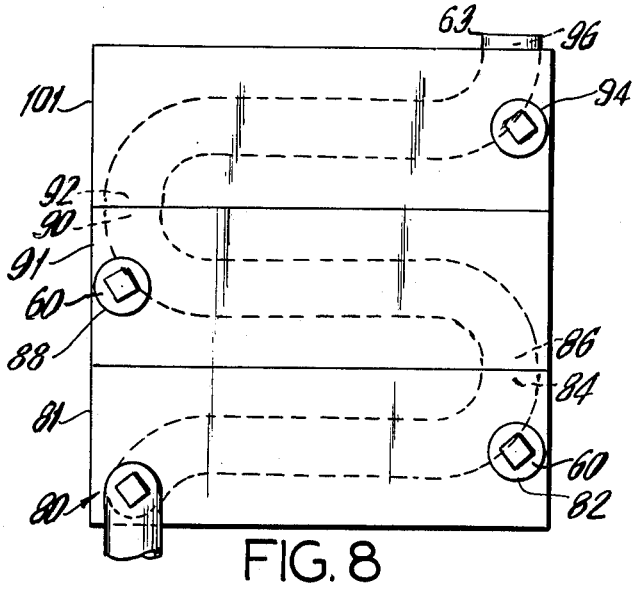
FIG. 8 is a schematic showing an alternate stacked modular muffler system according to the present invention.

In an alternate configuration shown in FIG. 8, the modules can be formed with a bottom section 81, left handed section 91 and right handed section 101. The bottom module has inlet 80 on one side near one end, first outlet 82 on the same side at the second end and second outlet 84 on an adjacent side at the second end. The left handed module has inlet 86 on one side at one end, first outlet 88 on an adjacent side at a second end and second outlet 90 at the second end on the side opposite that having inlet 86. The right handed module is the mirror image of the left handed module with inlet 92 and outlets 94 and 96 on adjacent and opposite sides respectively. Thus, exhaust air is directed into inlet 80 and flows through the muffler and leaves outlet 84 while outlet 82 is blocked by plug 60. The exhaust then enters left handed section 91 through inlet 86 with outlet 88 blocked by plug 60 and exits through outlet 90 to enter right handed section 101 via inlet 92. The exhaust can either be directed through outlet 96 into a second left handed section or through outlet 94, horizontally, to the atmosphere.

Figure 9:
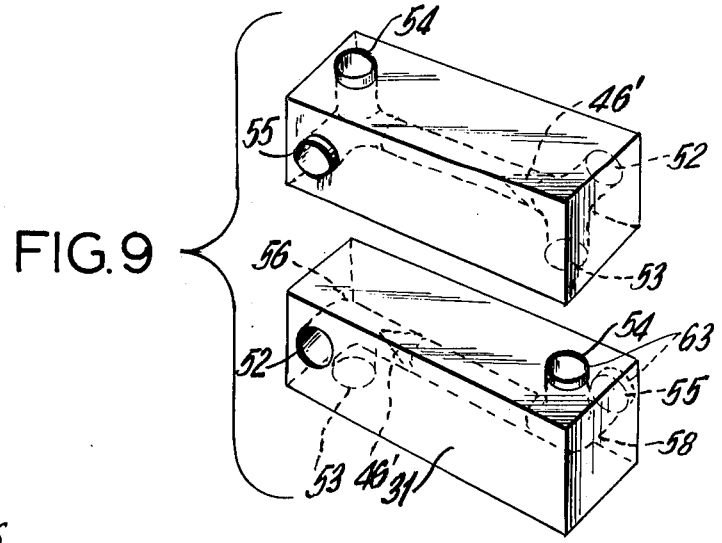
FIG. 9 is a perspective view of the muffler module according to the present invention having two inlets and two outlets.

Referring now to FIG. 9, the preferred embodiment for the modular muffler configuration according to the present invention, the muffler comprises a plurality of muffler modules 50, each having two inlet ports 52 and 53, and two outlet ports 54 and 55. Each module contains muffler passage 35, having a perforated straight section 36 and unperforated curved sections or end pieces 56 and 58 which are conduits connecting the perforated straight section to the inlet ports and the outlet ports respectively. The straight section of the muffler passage is wrapped with screening 40 and the entire muffler is in turn surrounded by acoustical absorbing material 42 completely filling the space in the housing.

Advantageously, the outlet and inlet ports are arranged such that the two inlets 52 and 53 are at one end of the housing on adjacent sides and the two outlets 54 and 55 are at the other end on the remaining two sides. The end pieces are adapted such that end piece 56 connects one end of the straight section to both inlet ports 52 and 53, and end piece 58 connects the other end of the straight section to both outlet ports 54 and 55. Preferably, end pieces 56 and 58 are bifurcated elbow joints, formed with extension 46' on the end of end piece 56 connected to section 36, similar to aerodynamic shield 46 in FIG. 4, to prevent exhaust air from penetrating the acoustical absorbing material as the flow is "bent" after entering either inlet, 52 or 53. If extension 63 is not provided, shield 46' can be formed on both end pieces, 56 or 58, obviating criticality of arrangement whereby inlets and outlets are interchangeable. Sealing means 60 are provided to block one inlet and one outlet in each housing module so that the module has only one functioning inlet and outlet during operation.

The muffler modules are arranged as shown in FIG. 8 such that each interior muffler has its first inlet and second outlet closed and sealed by sealing means 60 and its first outlet connected to the second inlet of the adjacent muffler module by connecting means 48. The first muffler module has its second inlet and second outlet closed while the last muffler has its first inlet and first outlet closed whereby a serpentine-like muffler passage is formed. For most practical applications, the modular muffler housing measures about 32 inches in length with a square or nearly square cross-section measuring from between 8 × 8 to 10 × 10. A particularly useful cross-section measures 8 × 10, complementing the straight portion of the muffler passage which measures from 18 to 20 inches in length.

In operation, exhaust from the hammer actuating chamber or other exhaust source enters inlet port 52. The exhaust is directed by end piece 56 to perforated straight section 36 where sound waves carried by the exhaust air pass through the perforations 44 and screening 40 to the acoustical absorbing material 42. The air is prevented access to the absorbing material by the screening to keep oil and other contaminants from damaging the acoustical absorbing material. The sound waves then penetrate the perforations and screening to the acoustical material 42 which absorbs energy therefrom, as described above. The diminished sound waves re-enter the muffler passage through other perforations and rejoin the exhaust air flow which is ultimately directed to unperforated outlet end piece 58. With one outlet blocked by sealing means 60, the exhaust air is expelled from outlet 54 and flows through the coupling 48 into the second inlet, 53, of an adjacent muffler module after which the exhaust experiences the same process. Thus a serpentine path is established, leading to the last muffler module through which quieted exhaust is expelled horizontally from outlet 55 by blocking the first outlet, 54 of the last module.

Figure 10:
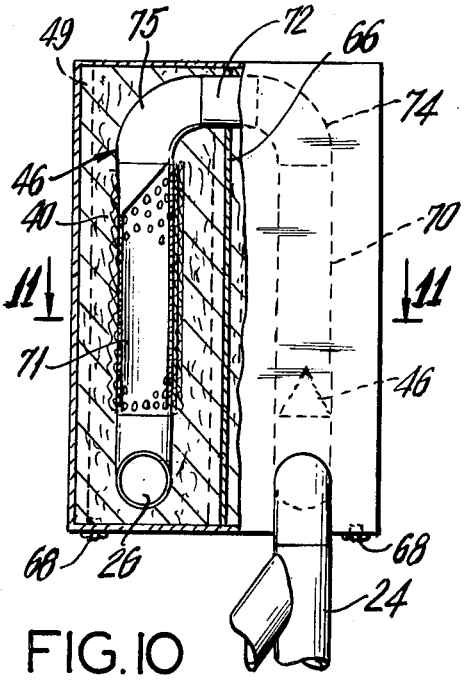
FIG. 10 is a schematic showing the two chambered, U-shaped muffler system according to the present invention.
Figure 11:
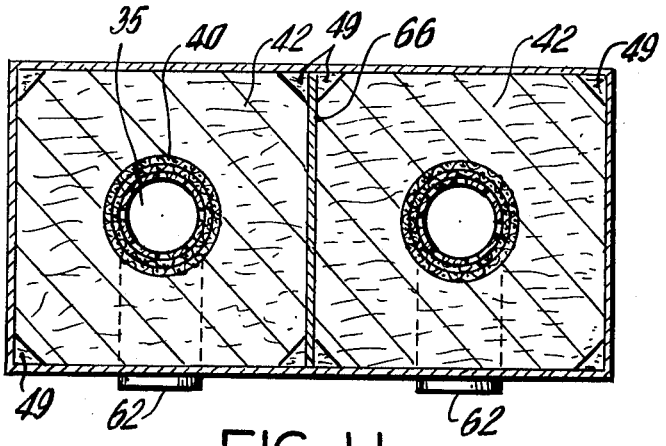
FIG. 11 shows a cross-sectional view of the two chambered muffler system according to the present invention taken along the line 11—11 of FIG. 10.

FIGS. 10 and 11 show a particularly useful embodiment of the present invention which can be utilized by the majority of existing pile driving apparatus without necessitating additional equipment. It includes a U-shaped muffler passage fitted into a two chambered housing wherein the two chambers 62 and 64 share a single common side or septum 66 through which the U-shaped muffler passage passes. In essence, the muffler according to this aspect of the present invention is a single unit formed by the combination of two muffler modules which share one common side, 66, rather than having two separate housing sides lie adjacent. The septum 66 therefore creates two acoustical isolation chambers of nearly square cross-section in a single housing. The septum serves two functions. It adds structural rigidity to the single housing and it prevents oblique sound waves from bypassing the full muffler passage via a flanking path between the perforations near the inlet to those near the outlet. The muffler according to this aspect of the present invention provides a structurally integral noise attenuating device minimizing the possibility of noise "leakage" to the environment and a muffler which is conveniently sized and suited for pile driver applications. Accordingly, an efficient noise attenuation passage is provided in a compact structure to make optimum utilization of available space.

The housing has inlet port 24, outlet port 26 and fittings 62 adapted to receive hoses, etc. for directing exhaust gas into the muffler. The housing encloses a U-shaped muffler passage which comprises perforated straight sections 70 and 71, unperforated straight section 72 and unperforated curved sections 74 and 75. Perforated straight sections 70 and 71 are wrapped with screening 40 and the entire housing is filled with acoustical absorbing material 42 so that the housing is fully packed with absorbing material.

In a particularly useful embodiment of the bi-chambered muffler, the inlet and outlet are on a side of the housing so that the quieted exhaust is expelled horizontally away from the muffler and the pile driving apparatus. The preferred acoustical absorbing material is fiberglass without or nearly without binders and it is wrapped tightly around the muffler passage from maximum noise absorption and for damping the housing to prevent reverberations. Furthermore, wedges of bonded fiberglass 49, triangular in cross-section, are glued into all four longitudinal corners of both chambers. These wedges serve to simplify fabrication of the muffler by supporting the fiberglass wrapping around the muffler passage, fill the voids in the corners to prevent noise concentration therein and enhance the damping on the housing walls thus greatly enhancing the noise absorption and attenuation capability of the muffler.

In this configuration, the muffler can be constructed to any convenient length since the muffler according to this aspect of the present invention can be oriented so that its length measures vertically. The only restriction on height is the clearance above the cradle. A particularly useful size is 36 inches tall, 24 inches wide and 10 inches deep whereby the cross-section of each chamber is about 10 × 12 inches. Accordingly, the perforated straight section measures about 24 inches in each acoustical isolation chamber which has proven a highly efficient length.

From the foregoing detailed description, it will be apparent that the muffler system contemplated by the present invention provides significant noise attenuation which can be increased or decreased as desired. The fiberglass wrapping in conjunction with the fiberglass cornerpieces provide significant damping of the outer housing at resonant frequencies of the housing. The use of steel in the housing, muffler passages and the septum is particularly advantageous since it not only provides structural rigidity but also resonates at mid range frequencies while most exhaust is in the high frequency range. Thus, reverberations of the housing is effectively minimized so that the muffler housing is not transformed into a source for noise.

As a precaution against oil and moisture build-up, drain ports 68, in the form of pet cocks, may be installed in the housing to drain any accumulation of oil and grease. It has been found however, that in the muffler according to the present invention, when a small amount of oil does penetrate the screening and coats the fibers of the absorbing material, the life of the muffler may be enhanced because the pieces are made more ductile.

Those skilled in the muffling art will recognize that certain changes may be made in the construction, proportion and arrangement of parts of the illustrative embodiment without departing from the spirit of the invention.

What is claimed is:

1. A muffler for attenuating exhaust noise from a pile driving apparatus, which comprises a first muffler section comprising:

a housing having two ends;

a first inlet port formed in a side of said housing substantially near a first end thereof;

a first outlet port formed in a side of said housing substantially near a second end thereof;

an elongated muffler passage in said housing, having a perforated substantially straight portion, said straight section extending substantially from said first end of said housing to said second end of said housing;

an unperforated inlet end piece adapted to connect a first end of said straight section to said first inlet and an unperforated outlet end piece adapted to connect a second end of said straight section to the first outlet, said first and second end pieces being elbow pipe joints;

acoustical absorbing material in said housing surrounding said perforated straight section and filling said housing; and screen means between said perforated straight section and said acoustical absorbing material, surrounding and in contact with said perforated straight section, said screen means being proportioned to permit access of acoustical waves from said exhaust gas noise to said acoustical absorbing material and to substantially prevent access of the exhaust gas and its contaminants to said acoustical absorbing material;

said first inlet port being adapted for connection to a source of exhaust gas such that said exhaust gas travels through said muffler passage wherein noise associated with said exhaust gas is substantially attenuated.

2. A muffler according to claim 1 wherein said inlet end piece has an unperforated shield extension on its end thereof connected to the straight section such that the shield extension forms an unperforated section of the straight portion, said shield extension being substantially on a portion of the muffler passage farthest from said first inlet port to prevent incoming exhaust gas from penetrating the acoustical absorbing material as it flows through the elbow joint.

3. The muffler in accordance with claim 2 wherein said first inlet port is on a first side of said housing and said first outlet port is on a second side opposite said first side.

4. The muffler in accordance with claim 3 wherein said perforations are about ⅜ inch in diameter and said screen means are wrapped at least twice around said straight portion.

5. The muffler in accordance with claim 4 in which the housing, the exhaust passage and the end pieces are made of steel and said acoustical absorbing material is finely woven fiberglass substantially free of binders tightly and densely wrapped around said muffler chamber.

6. The muffler in accordance with claim 5 further comprising solid bonded fiberglass cornerpieces having a substantially triangular cross-section bonded into all four lengthwise corners of the housing, substantially parallel to said perforated straight section and drain ports in said housing to drain off collected moisture, oils and other liquids.

7. The muffler in accordance with claim 6 which further comprises:

at least one additional muffler section identical to said first muffler section;

means for connecting the first outlet port of one muffler section to the first inlet of another muffler section, such that said muffler sections can be placed adjacent one another with said connecting means interposed between said muffler sections to form a continuous muffler passage of substantial length.

8. A muffler according to claim 7, wherein said connecting means comprises recesses in said inlet and outlet ports and a resilient o-ring compressed within said recesses.

9. The muffler in accordance with claim 6 which further comprises:

a second inlet on a third side of said housing adjacent the second side and substantially near the first end of said housing;

a second outlet on a fourth side of said housing opposite said third side and substantially near the second end of said housing, wherein said inlet end piece is adapted to connect the first end of said perforated straight portion to both the first and the second inlets and said outlet end piece is adapted to connect the second end of said perforated straight portion to both the first and the second outlets.

10. The muffler in accordance with claim 9 which further comprises:

an end muffler section identical to said first muffler section;

means for connecting an outlet port to an inlet port;

sealing means for closing and sealing the first inlet port and second outlet port in said first muffler section and the second inlet port and the first outlet port of the end muffler section, such that said muffler sections can be placed adjacent one another and connected in series providing a continuous muffler passage for attenuating noise associated with exhaust gas.

11. The muffler according to claim 10 which further comprises at least one interior muffler section between said first and end muffler sections, the first outlet port of each muffler section except said end muffler section being connected to the first inlet port of a next adjacent muffler section, the first inlet and second outlet of said first muffler section being closed and sealed by said sealing means, the second inlet and second outlet of each interior muffler section being closed and sealed by said sealing means and the second inlet and first outlet of said end muffler section being closed and sealed by said sealing means, to provide a continuous serpentine-like muffler passage of substantial length for attenuating noise from pile driver exhaust.

12. A muffler according to claim 11 wherein said connecting means comprises recesses in said inlet and outlet ports and a resilient o-ring compressed therebetween.

13. A muffler for attenuating exhaust noise from a pile driving apparatus comprising:

a housing having four sides and two ends;

a solid septum in the housing, dividing said housing into two acoustical isolation chambers of substantially equal volume, one of said chambers having an inlet port in one of said housing sides and another of said chambers having an outlet port in one of said sides, both said inlet and outlet ports being located substantially near one end of said housing;

a U-shaped muffler passage within said housing connecting said inlet port to said outlet port and passing through said solid septum substantially near a second end of said housing opposite the first end, said U-shaped muffler passage having two perforated substantially straight portions, forming both legs of said U-shaped, two unperforated curved sections and an unperforated straight section passing through said septum;

screen means surrounding said perforated straight leg portions;

acoustical absorbing material filling said housing between its inner housing walls and said muffler passage;

an unperforated inlet end piece connecting one end of a first perforated straight leg portion to said inlet port;

an unperforated outlet end piece connecting one end of a second perforated straight leg portion to said outlet port;

said screen means being interposed between said acoustical absorbing material and said straight leg portions such that exhaust gas directed into said inlet port passes through said U-shaped muffler passage such that said exhaust gas is substantially prevented from penetrating the acoustical absorbing material while acoustical waves carried by said exhaust gas penetrate said acoustical absorbing material whereby energy from said acoustical waves is absorbed, providing significant attenuation of exhaust noise.

14. A muffler according to claim 13 wherein said housing, said septum and said muffler passage are made of steel, said inlet end piece and said outlet end piece are elbow joints and said acoustical absorbing material is finely woven fiberglass substantially free of binders wrapped tightly and densely around the muffler passage.

15. A muffler according to claim 14 wherein said inlet end piece has an unperforated shield extension forming an unperforated section of said straight leg section along a side thereof farthest from said inlet port.

16. A muffler according to claim 15 wherein said screen is wrapped at least twice around said perforated leg portions.

17. A muffler according to claim 16 wherein said inlet and outlet ports are on the same side of said housing and said outlet port is oriented such that quieted exhaust is expelled substantially horizontally.

18. A muffler according to claim 17 wherein the perforations are about ⅜ inch in diameter.

19. A muffler according to claim 18 wherein bonded fiberglass cornerpieces are affixed into all four lengthwise corners in both acoustical isolation chambers to prevent concentration of noise in said corners.

20. A muffler according to claim 19 which futher comprises drain ports in said housing to drain collected oil, moisture and other contaminants.

* * * * *

UNITED STATES PATENT AND TRADEMARK OFFICE

CERTIFICATE OF CORRECTION

PATENT NO. : 3,981,378

DATED : September 21, 1976

INVENTOR(S) : Stannard M. Potter

It is certified that error appears in the above-identified patent and that said Letters Patent are hereby corrected as shown below:

In Column 2, line 5, "leeds" should be --leads--;
In Column 2, line 20, "leeds" should be --leads--;
In Column 2, line 27, "leeds" should be --leads--;
In Column 3, line 9, "leeds" should be --leads--;
In Column 3, line 21, "leeds" should be --leads--;
In Column 7, line 37, "from" should be --for--.

In Claim 20, line 1, "futher" should be --further--.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*